US006299419B1

(12) United States Patent
Hunklinger et al.

(10) Patent No.: US 6,299,419 B1
(45) Date of Patent: Oct. 9, 2001

(54) RECIPROCATING DIAPHRAGM PUMP WITH PACKLESS PISTON-CYLINDER UNIT

(75) Inventors: Herbert Hunklinger, Ruhpolding; Klaus Rutz, Vachendorf, both of (DE)

(73) Assignee: Lang Apparatebau GmbH (Lang) (DE)

( * ) Notice: Subject to any disclaimer, the term of this patent is extended or adjusted under 35 U.S.C. 154(b) by 0 days.

(21) Appl. No.: 09/424,355

(22) PCT Filed: May 12, 1998

(86) PCT No.: PCT/EP98/02766

§ 371 Date: Jan. 21, 2000

§ 102(e) Date: Jan. 21, 2000

(87) PCT Pub. No.: WO98/53208

PCT Pub. Date: Nov. 26, 1998

(30) Foreign Application Priority Data

May 21, 1997 (DE) ..... 297 08 906 U

(51) Int. Cl.[7] ..... F04B 7/04; F04B 23/08; F04B 19/00

(52) U.S. Cl. ..... 417/490; 417/489; 417/199.1; 92/98 R; 92/99

(58) Field of Search ..... 417/490, 199.1, 417/489; 92/98 R, 99

(56) References Cited

U.S. PATENT DOCUMENTS

| | | | | |
|---|---|---|---|---|
| 3,495,544 | * | 2/1970 | Enssle | 417/307 |
| 3,602,613 | | 8/1971 | Guenther et al. | 417/437 |
| 4,516,479 | * | 5/1985 | Vadasz | 92/170 |
| 4,572,056 | | 2/1986 | Funke | 92/86 |
| 4,883,467 | * | 11/1989 | Franetzki et al. | 417/417 |
| 5,492,449 | * | 2/1996 | Hunklinger et al. | 417/413.1 |

FOREIGN PATENT DOCUMENTS

| | | | |
|---|---|---|---|
| 25 49 008 | | 5/1977 | (DE) . |
| 3629742 A | * | 3/1988 | (DE) . |
| 0 129 187 | | 12/1984 | (EP) . |
| 2 370 877 | | 6/1978 | (FR) . |

* cited by examiner

*Primary Examiner*—Timothy S. Thorpe
*Assistant Examiner*—Michael K. Gray
(74) *Attorney, Agent, or Firm*—Merchant & Gould P.C.

(57) ABSTRACT

This invention provides a sealing mechanism for sealing the piston-cylinder unit of a reciprocating diaphragm pump to ensure that the piston-cylinder unit is permanently and reliably sealed while being simple to assemble. The invention further provides a piston-cylinder unit which has almost no play in the micrometer ($\mu$m) range, and which is sealed by hydrodynamically sealing a slot thereof.

7 Claims, 1 Drawing Sheet

RECIPROCATING DIAPHRAGM PUMP WITH PACKLESS PISTON-CYLINDER UNIT

BACKGROUND 1.0 Field Of The Invention

This invention relates generally to reciprocating diaphragm pumps, and more particularly to the sealing of the dosing piston/cylinder unit of a reciprocating diaphragm pump.

2.0 Discussion Of Related Art

The dosing precision of reciprocating diaphragm pumps depends on the exactness with which the dosing piston is sealed in the associated cylinder unit. The use of mechanical sealing elements, for example O-rings, has the disadvantage that when the sealing elements wear, dosing accuracy is reduced. In addition, it is often very difficult and expensive to maintain the narrow tolerances essential for adequate precision at the assembly stage.

European patent EP-B-0 129 187 describes a reciprocating diaphragm pump with pre-delivery. In this pump, the dosing piston is actuated via a slidably mounted drive piston. The product to be delivered or dosed is fed to the dosing piston by means of a membrane. The dosing piston/cylinder unit sealed by O-rings as the sealing element. The system of dosing piston, sealing elements and stroke adjustment screw is subject to wear and limits the useful life. The more stringent the requirements which dosing precision has to satisfy, the shorter the time a system such as this can be used without readjustment or replacement of the sealing elements.

SUMMARY OF THE INVENTION

An object of the present invention is to ensure simple assembly and guarantee exact sealing of the dosing piston/cylinder unit of a reciprocating diaphragm pump.

In a one embodiment of the invention, a sealing system of the pump includes a dosing piston/cylinder unit that is substantially free from play in the micrometer range and is sealed by a hydrodynamic gap seal.

In another embodiment of the invention, a reciprocating diaphragm pump includes a dosing piston guided with minimized play, i.e. with a tolerance in the $\mu$m range, in that both part of the cylinder which forms the compression zone, and the gap remaining between the dosing piston and the cylinder are sealed by a hydrodynamic gap seal which seals by means of the product taken in by the pump. The hydrodynamic gap seal works without wearing and, accordingly, provides for virtually unlimited useful life in regard to the sealing of the system.

In a preferred embodiment of the invention, the dosing piston and the cylinder are made of oxide ceramic. The fact that the dosing piston/cylinder is made of oxide ceramic has the particular advantage that these elements can readily be manufactured to the narrowest tolerances.

In another embodiment of the sealing system and the reciprocating diaphragm pump, the dosing piston is floatingly actuated via a coupling and, in the reciprocating diaphragm pump, the dosing piston is floatingly connected by a coupling to a drive piston. The floating actuation of the dosing piston via a coupling provides for simple assembly and enables the dosing piston/cylinder unit to operate with high reliability.

BRIEF DESCRIPTION OF THE DRAWINGS

The invention is described in more detail in the following with reference to the sole FIGURE of the accompanying drawing.

DETAILED DESCRIPTION OF THE INVENTION

Figure 1:
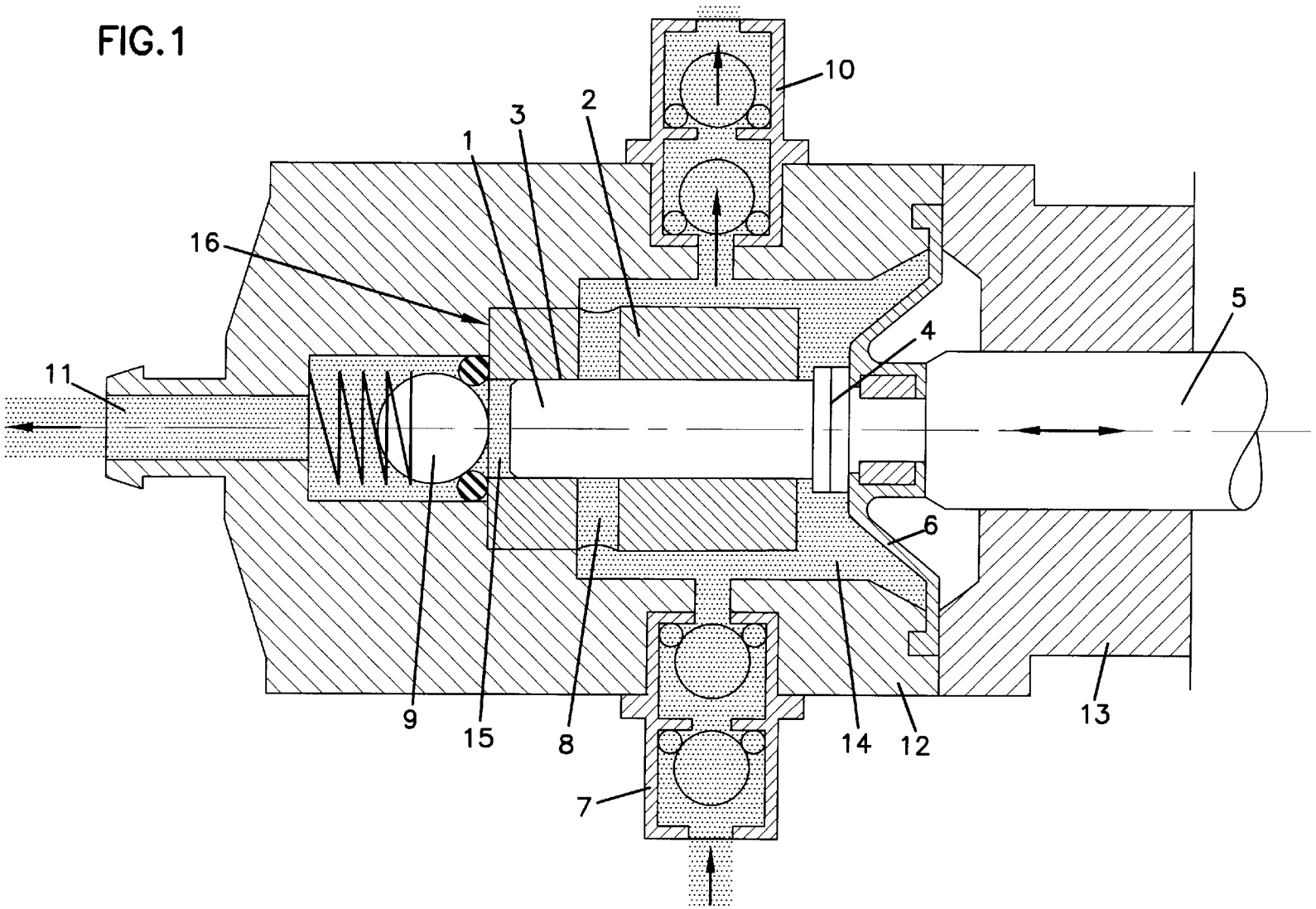

In the reciprocating diaphragm pump illustrated in the drawing, a drive with a drive piston 5 projects laterally into the reciprocating diaphragm pump. Between two pump housing parts 12, 13, a diaphragm 6 is sealingly arranged in a circle in an inner pump chamber 14. The diaphragm 6 is tightly clamped at its periphery and allows the drive piston 5 to make a reciprocating movement in its directions of movement indicated by a double arrow. In the direction away from the inner pump chamber 14, the drive piston 5 with the diaphragm 6 arranged thereon makes a lifting or suction movement (suction stroke); in the direction towards the inner pump chamber 14, it makes a compression movement (pumping stroke).

In the middle of the reciprocating diaphragm pump, a dosing piston 1 and a cylinder 2 are disposed as a co-operating pair of elements inside the inner pump chamber 14. The dosing piston 1 and the cylinder 2 form a dosing piston/cylinder unit 16. The dosing piston 1 is connected to the drive piston 5 by a coupling 4 so that the lifting and compression movements of the drive piston coupling 5 are transmitted to the dosing piston 1. A control bore 8 extends through the cylinder 2. A dosing opening 11—opposite the diaphragm 6—of the reciprocating diaphragm pump is actuated by a control valve 9. In addition, the reciprocating diaphragm pump comprises a suction valve 7 and a return pressure valve 10 on opposite sides of the inner pump chamber 14. The gap 3 between the dosing piston 1 and the cylinder 2 is hydrodynamically sealed by the liquid product situated in the inner pump chamber 14, and in a compression chamber 15. In this part of the cylinder 2 forming the compression chamber 15, the dosing piston 1 is guided substantially free from play with a tolerance in the $\mu$m (micrometer) range.

The reciprocating diaphragm pump operates as follows: when the diaphragm 6 moved by the drive piston 5 moves away from the inner pump chamber 14 (suction stroke), product is taken in through the suction valve 7 and a vacuum or reduced pressure is created in the compression chamber 15 of the dosing piston/cylinder unit 16. If, during the corresponding lifting movement of the dosing piston 1, the control bore 8 in the cylinder 2 is opened, the product pre-delivered into the inner pump chamber 14 by the lifting movement of the diaphragm 6 flows into the compression zone 15. During the compression movement (pumping stroke) of the drive piston 5 with the dosing piston 1 towards the dosing opening 11, the control bore 8 is closed again. Pressure is applied by the dosing piston 1 to the liquid then enclosed in the compression chamber 15 with the result that the pressure valve 9 opens and liquid product is dosed through the dosing opening 11. At the same time, excess product is returned via the return pressure valve 10 to an intake container operatively connected to the reciprocating diaphragm pump, the return pressure valve 10 opening under the effect of the pressure applied by the diaphragm 6 to the product present in the inner pump chamber 14.

Towards the drive or diaphragm piston 5, the coupling 4 connecting the dosing piston 1 and the drive piston 5 has a shape adapted to the corresponding end face of the diaphragm piston 6, and for "floatingly" connecting the dosing piston 1 and the drive piston 5 so that even a central shift, for example, can easily be compensated by assembly and manufacturing tolerances. This provides for inexpensive manufacture because the "floating" connection eliminates the requirement for narrow tolerances.

What is claimed is:

1. A pump for dispensing an accurate dose of a liquid product, said pump comprising:

a pump housing;

an inner pump chamber for receiving and containing a liquid product to be dosed;

a cylinder contained within the housing;

a dosing piston configured for sliding within said cylinder, said piston forming, in combination with said cylinder, a compression chamber during a stroke cycle of the dosing piston;

a gap formed between the dosing piston and cylinder, said gap being hydrodynamically sealed by the liquid product occupying the inner pump chamber and the compression chamber;

a diaphragm connected to said dosing piston, said diaphragm being in contact with the liquid product in said inner pump chamber; and a control bore formed in the cylinder for providing a fluid connection between the compression chamber and the inner chamber during a stroke cycle of the dosing piston, for permitting the liquid product to flow from the inner chamber into the compression chamber prior to dispensing.

2. The pump of claim 1, wherein said inner chamber is in fluidic connection with both a supply flow regulator for receiving liquid product from the latter, and an exit flow regulator for releasing excess liquid product from said inner chamber to the former, under conditions of vacuum and positive pressure caused by different stroke cycles of the dosing piston, respectively, within the inner chamber.

3. The pump of claim 1, further comprising:

a dosing opening for dispensing the liquid product from said compression chamber during a stroke cycle of the dosing piston; and a control valve located between said dosing opening and said compression chamber, said control valve being configured for permitting the liquid product to exit the compression chamber under positive pressure, while preventing back flow of the liquid product into the compression chamber under vacuum.

4. The pump of claim 1, wherein said dosing piston and said cylinder consist of oxide ceramic.

5. The pump of claim 1, further comprising:

a drive piston configured for actuating the sliding movement of the dosing piston within the cylinder; and a coupling for connecting the drive piston to the dosing piston, said coupling being further adapted for compensating for manufacturing tolerances or variations between said dosing and drive pistons.

6. The pump of claim 2, wherein said supply and exit flow regulators are each comprised of at least one check valve.

7. The pump of claim 3, wherein the control valve includes a ball check valve.

* * * * *